US007958938B2

(12) United States Patent
Crossley et al.

(10) Patent No.: US 7,958,938 B2
(45) Date of Patent: Jun. 14, 2011

(54) SYSTEM AND VESSEL FOR SUPPORTING OFFSHORE FIELDS

(75) Inventors: Calvin W. Crossley, Houston, TX (US); Tracy A. Fowler, Sugar Land, TX (US); M. Sidney Glasscock, Houston, TX (US); Matthew N. Greer, Kingwood, TX (US); Roald T. Lokken, Houston, TX (US); Dinesh R. Pejaver, Sugar Land, TX (US); W. Brett Wilson, Spring, TX (US); David B. Yost, Highgate Hill (AU)

(73) Assignee: ExxonMobil Upstream Research Company, Houston, TX (US)

( * ) Notice: Subject to any disclaimer, the term of this patent is extended or adjusted under 35 U.S.C. 154(b) by 886 days.

(21) Appl. No.: 11/578,093

(22) PCT Filed: Feb. 23, 2005

(86) PCT No.: PCT/US2005/005603

§ 371 (c)(1),
(2), (4) Date: Nov. 9, 2007

(87) PCT Pub. No.: WO2005/111369

PCT Pub. Date: Nov. 24, 2005

(65) Prior Publication Data

US 2008/0210432 A1 Sep. 4, 2008

Related U.S. Application Data

(60) Provisional application No. 60/567,589, filed on May 3, 2004.

(51) Int. Cl.
*E21B 29/12* (2006.01)

(52) U.S. Cl. ..... 166/366; 166/345; 166/381; 166/339; 175/5

(58) Field of Classification Search ..... 166/335, 166/336, 337, 345, 369, 381, 358, 366, 367; 175/5, 7
See application file for complete search history.

(56) References Cited

U.S. PATENT DOCUMENTS 3,366,173 A * 1/1968 McIntosh ..... 166/356
(Continued)

FOREIGN PATENT DOCUMENTS

GB 2299108 9/1996
(Continued)

OTHER PUBLICATIONS

EPO Standard Search Report dated Oct. 21, 2004, 3 pgs.

(Continued)

*Primary Examiner* — Thomas A Beach

(57) ABSTRACT

A system for supporting multiple-well-site, offshore, hydrocarbon-bearing fields, each well-site has one or more wells. In general, the system first comprises a floating vessel that is relocatable from a first subsea well-site to a second subsea well-site. The system also comprises two separate systems: (1) an operations control system for providing subsea well-site operations such as power and communications; and (2) an intervention system for conducting intervention services to an individual subsea well such as workover services and maintenance services. The operations system may provide control to wells and other subsea equipment at either the first well-site or the second well-site, regardless of the location of the floating vessel. The intervention system may provide workover and/or maintenance to subsea equipment or individual wells at the well-site at which it is located.

22 Claims, 5 Drawing Sheets

U.S. PATENT DOCUMENTS

| | | | | | |
|---|---|---|---|---|---|
| 3,444,927 | A | * | 5/1969 | Childers et al. | 166/351 |
| 3,504,741 | A | * | 4/1970 | Talley, Jr. et al. | 166/356 |
| 3,602,302 | A | | 8/1971 | Kluth | 166/0.5 |
| RE27,745 | E | * | 8/1973 | Brooks et al. | 166/336 |
| 4,052,703 | A | | 10/1977 | Collins et al. | 364/200 |
| 4,138,669 | A | * | 2/1979 | Edison et al. | 340/3.51 |
| 4,337,829 | A | * | 7/1982 | Banzoli et al. | 166/366 |
| 4,367,980 | A | | 1/1983 | Ames et al. | 405/169 |
| 4,371,037 | A | | 2/1983 | Arnaudeau | 166/366 |
| 4,378,848 | A | | 4/1983 | Milberger | 166/362 |
| 4,452,312 | A | * | 6/1984 | Roblin | 166/339 |
| 4,624,318 | A | * | 11/1986 | Aagaard | 166/359 |
| 4,730,677 | A | | 3/1988 | Pearce et al. | 166/345 |
| 4,732,215 | A | * | 3/1988 | Hopper | 166/366 |
| 4,848,474 | A | * | 7/1989 | Parizot et al. | 166/366 |
| 4,848,475 | A | * | 7/1989 | Dean et al. | 166/357 |
| 5,025,865 | A | * | 6/1991 | Caldwell et al. | 166/366 |
| 5,207,534 | A | | 5/1993 | Brasted et al. | 405/209 |
| 5,226,482 | A | | 7/1993 | Giannesini et al. | 166/353 |
| 5,255,744 | A | | 10/1993 | Silva | 166/347 |
| 5,341,884 | A | | 8/1994 | Silva | 166/347 |
| 5,706,896 | A | | 1/1998 | Tubel et al. | 166/313 |
| 6,059,039 | A | | 5/2000 | Bednar et al. | 166/344 |
| 6,102,124 | A | * | 8/2000 | Skeels et al. | 166/347 |
| 6,182,763 | B1 | | 2/2001 | Ingebrigtsen et al. | 166/366 |
| 6,182,765 | B1 | | 2/2001 | Kilgore | 166/381 |
| 6,192,988 | B1 | | 2/2001 | Tubel | 166/313 |
| 6,263,971 | B1 | * | 7/2001 | Giannesini | 166/366 |
| 6,336,421 | B1 | * | 1/2002 | Fitzgerald et al. | 114/264 |
| 6,364,021 | B1 | | 4/2002 | Coats | 166/350 |
| 6,397,948 | B1 | | 6/2002 | Williams et al. | 166/363 |
| 6,461,083 | B1 | | 10/2002 | Pionetti et al. | 405/224.2 |
| 6,488,093 | B2 | | 12/2002 | Moss | 166/339 |
| 6,494,271 | B2 | | 12/2002 | Wilson | 166/344 |
| 6,536,528 | B1 | * | 3/2003 | Amin et al. | 166/369 |
| 6,564,872 | B2 | | 5/2003 | Davey et al. | 166/344 |
| 6,588,985 | B1 | | 7/2003 | Bernard | 405/191 |
| 6,640,900 | B2 | | 11/2003 | Smith | 166/336 |
| 6,640,901 | B1 | * | 11/2003 | Appleford et al. | 166/357 |
| 6,725,936 | B2 | | 4/2004 | Hopper | 166/366 |
| 6,763,889 | B2 | | 7/2004 | Rytlewski et al. | 166/341 |
| 6,772,840 | B2 | | 8/2004 | Headworth | 166/302 |
| 6,873,267 | B1 | * | 3/2005 | Tubel et al. | 340/853.3 |
| 6,913,083 | B2 | * | 7/2005 | Smith | 166/336 |
| 7,032,658 | B2 | * | 4/2006 | Chitwood et al. | 166/61 |
| 7,137,451 | B2 | * | 11/2006 | Smith | 166/335 |
| 2005/0178556 | A1 | * | 8/2005 | Appleford et al. | 166/366 |

FOREIGN PATENT DOCUMENTS

| | | |
|---|---|---|
| GB | 2367079 | 3/2002 |
| WO | 2004/003339 | 1/2004 |

OTHER PUBLICATIONS

PCT International Search Report and Written Opinion dated Jul. 22, 2005, 6 pgs.

* cited by examiner

SYSTEM AND VESSEL FOR SUPPORTING OFFSHORE FIELDS

CROSS REFERENCE TO RELATED APPLICATIONS

This application claims the benefit of U.S. Provisional Application 60/567,589, filed May 3, 2004.

BACKGROUND

1. Field of Invention

Embodiments of the present invention generally relate to a system for supporting a plurality of hydrocarbon-bearing wells, including systems for providing production operations in multiple-well-site, offshore fields.

2. Description of Related Art

Over the last thirty years, the search for oil and gas offshore has moved into progressively deeper waters. Wells are now commonly drilled at depths of several hundred feet and even several thousand feet below the surface of the ocean. In addition, wells are now being drilled in more remote offshore locations.

Where the water is too deep to establish a foundation on the ocean floor for a production platform, a subsea wellhead may be placed on the ocean bottom. Alternatively, a floating production platform is provided for structurally supporting surface wellheads for wells in deep water. In either configuration, the wellheads will typically physically support concentric tubular pipe strings, such as casing and tubing, with the casing and tubing extending into the well bore. Production fluids may then be directed from a subterranean formation upward through the tubing and to the wellhead. From there, production fluids are delivered by a flow-line to a gathering system.

The drilling and maintenance of deep and remote offshore wells is expensive. In an effort to reduce drilling and maintenance expenses, remote offshore wells are oftentimes drilled in clusters. This allows a single floating rig or semi-submersible vessel to conduct drilling operations from essentially a single ocean location. Further, this facilitates the gathering of production fluids into a local production manifold after completion. Fluids from the clustered wells are oftentimes commingled at the manifold, and delivered together through a single flow-line. The flow line leading from the production manifold is sometimes referred to as a production export line. The clustering of wells also allows for one or more control lines to be run from a single location at the ocean surface, downward to the clustered wells. The control line ties into a control module on the manifold, and then branch to the various wellheads. Such a control line allows for the monitoring and control of valves, gauges, and other subsea equipment. Control lines also allow for one or more power lines or chemical delivery lines to be delivered from the ocean surface, downward to the clustered wells.

A grouping of wells in a clustered subsea arrangement is sometimes referred to as a "well-site." A well-site typically includes producing wells completed for production at one and oftentimes more pay zones. In addition, a well-site will oftentimes include one or more injection wells to aid production for water drive and gas expansion drive reservoirs. The wells may have "wet" wellheads, that is, the christmas tree is located on the ocean floor (known as a subsea tree or subsea well), or the wells may have "dry" wellheads, meaning that the christmas trees are located on a production platform above the ocean surface. It is desirable to be able to provide an inter well-site controls network by which operations at more than one well-site can be controlled from any of the well-site locations.

It is sometimes necessary to perform intervention services for these wells. Intervention operations involve the transport of a workover vessel to the subsea well-site, and then the running of tools and fluid into the hole for remedial or diagnostic work. Thus, it is also desirable to provide a floating vessel from which intervention services may be provided at one well-site, while utilizing the inter well-site controls network to control operations at that and other well-sites. Additional related information may be found in U.S. Pat. No. 4,052,703 to Collins et al. and GB 2,299,108 to Norske Stats Oljeselskap a.s.

SUMMARY

Described herein are various systems for supporting multiple-well-site, offshore, hydrocarbon-bearing fields. Each well-site has one or more wells. The system first comprises a floating vessel. The floating vessel is relocatable from a first offshore well-site to at least a second offshore well-site.

The system preferably includes an operations control system linking the various well-sites. The operations system is connectible to the floating vessel for simultaneously providing subsea well-site control operations at the first and second offshore well-sites. Control operations include communication lines for issuing control commands to equipment, and for retrieving data from sensors in the production system. Such operation lines may also provide electrical power, hydraulic fluid, or production chemicals. The operations system is configured to provide well control operations to one or more individual wells of both a first well-site and a second well-site (or more) while the floating vessel is located at either or any well site.

Next, the well-site support system also may include an intervention system. The intervention system is placed onboard the floating vessel for conducting intervention services to an individual well. The intervention services include at least one of workover services and maintenance services. The intervention system is configured to provide intervention services to any individual well of the first well-site while the floating vessel is located at the first well-site, and to any well (or other item of subsea equipment) of the second well-site after the floating vessel is relocated at the second well-site. The floating vessel is relocatable to any well-site to provide intervention services at that given well-site.

BRIEF DESCRIPTION OF THE DRAWINGS

A description of certain embodiments of the inventions is presented below. To aid in this description, drawings are provided, as follows.

DETAILED DESCRIPTION

Description of Specific Embodiments

Figure 1:
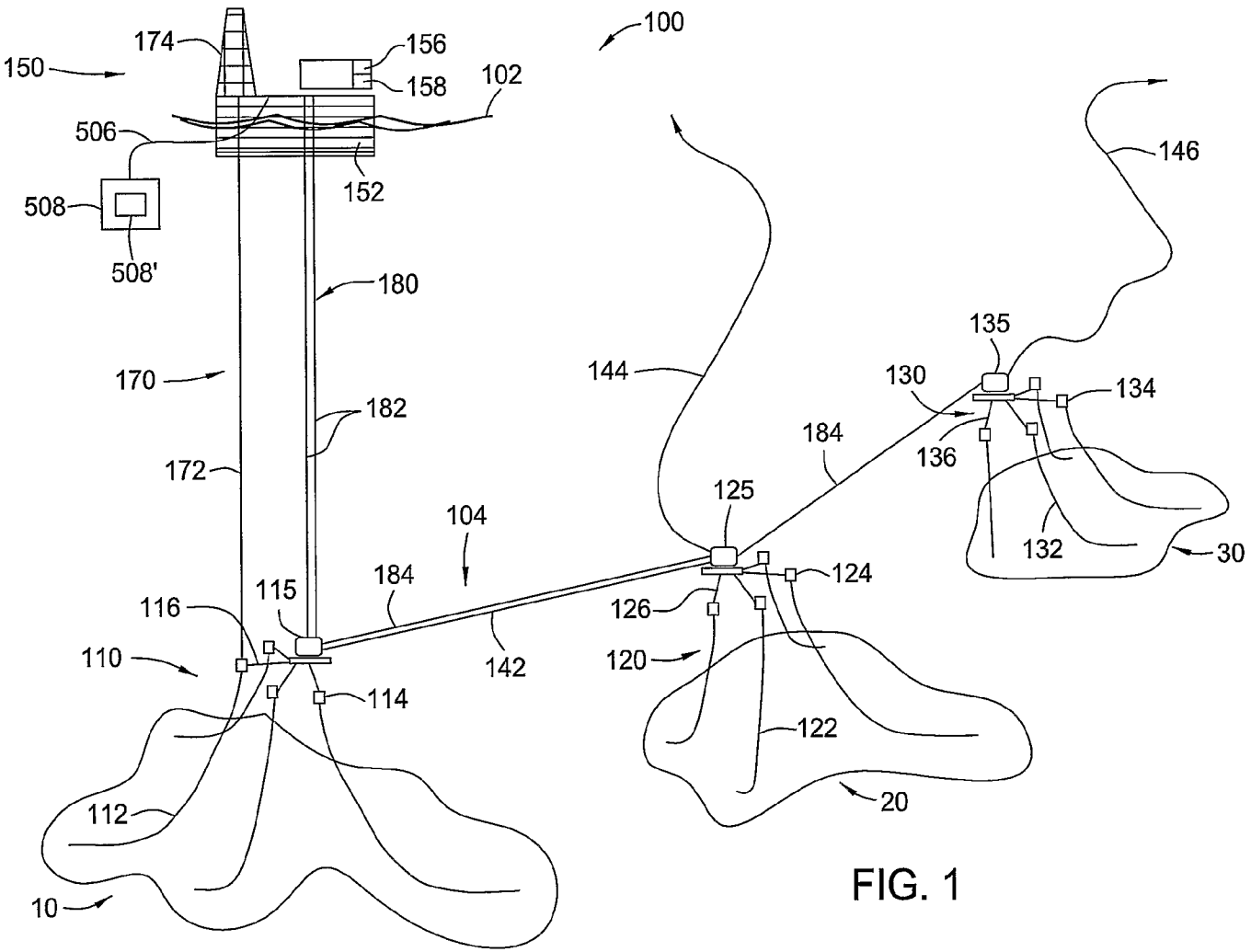
FIG. 1 presents a system for supporting multiple-well-site offshore hydrocarbon-bearing oil fields. In the illustrative system of FIG. 1, three separate subsea well-sites are presented, with each site having a plurality of wells clustered together. Each well has a wellhead fixed at the subsea mudline. A floating vessel is seen located above a first well-site, but may be relocated to any of the other well-sites.

The following provides a description of certain specific embodiments of the present invention:

A system is provided for supporting multiple-well-site, offshore, hydrocarbon-bearing fields. In the field or fields, each well-site has one or more wells. In one embodiment, the system includes a floating vessel that is relocatable from a position above a first subsea well-site to a position above a second subsea well-site. The system also includes an operations control system connectible to the floating vessel for providing subsea well-site operations at the first and second subsea well-sites.

In one embodiment, the operations control system includes a control module at the first well-site, a control module at the second well-site, an inter well-site control network connecting the control module at the first well-site to the control module at the second well site, and a detachable surface vessel control link configured to selectively connect with the control module at the first well-site and the control module at a second well-site. The operations control system enables control operations to be conducted for both the first well-site and the second well-site from either well-site location. The control operations for the operations control system include communications for at least one of commands sent to well-site equipment, and data received from sensors in the well-site equipment. The control communications may be selected from the group comprising: electrical signals, optical signals, wireless signals and combinations thereof. The control operations may further include the delivery of chemicals to selected flowlines, the deliver of hydraulic fluid to selected subsea equipment, the delivery of low voltage electrical power for control equipment, and the delivery of electrical power for high power production equipment.

In one embodiment, the floating vessel further comprises an intervention system onboard for conducting intervention services to an individual well. The intervention services comprise at least one of workover services and maintenance services.

In one embodiment, the system is used for providing both an operations control system and an intervention system through a floating vessel. The system may service either well-sites that have dry trees, that is, production heads on a production platform at the ocean surface, or wet trees, that is wellheads on the ocean bottom. In the latter instance, the well-site is a subsea well-site. In one arrangement, the system further includes a subsea separator capable of separating producing gas from produced liquids, the subsea separator receiving produced fluids from wells at a subsea well-site, and a return gas fuel line for delivering separated gas to the vessel.

In one arrangement, the inter well-site control network of the system defines at least one cable having a first end connected to the control module at the first well-site, and a second end connected to the control module at the second well-site.

In one embodiment, a system for supporting multiple-well-site, offshore, hydrocarbon-bearing fields, includes a vessel that is capable of floating, the vessel having a bow, a stern, one or more propellers, and an engine associated with the one or more propellers; a well intervention apparatus selected from the group consisting of a derrick, a coiled tubing spool, a wireline and an ROV, wherein the well intervention system is "substantially" affixed to the vessel; and one or more flexible cables capable of extending downward from the vessel when it is floating offshore, to a sub-sea well-site, the one or more cables providing control operations comprising at least communications for commands sent to well-site equipment, and data received from sensors in well-site equipment; and electrical power for providing power from the vessel to subsea equipment located at a first subsea well-site and a second subsea well-site. The one or more flexible cables may define a conductive line for transmitting the electrical power from the vessel to the sub-sea well-sites. The one or more flexible cables may also define a line for transmitting communications for commands and data between the vessel and the sub-sea well-sites. The one or more flexible cables may further comprise a conduit for delivering chemicals from the vessel to the sub-sea well-sites.

A floating vessel is also provided for supporting multiple-well-site, offshore, hydrocarbon-bearing fields. The floating vessel is relocatable from a first well-site to a second well-site so that control operations may be conducted for both the first well-site and the second well-site from either well-site location. The floating vessel is adapted to connect to a detachable surface vessel control link configured to selectively connect with a control module at the first well-site or a control module at a second well-site. The control module at the first well-site and a control module at a second well-site are connected by an inter well-site control network, thereby forming an operations control system connectable to the floating vessel for providing well-site operations simultaneously to each of the first and second well sites. Such operations may include communications for at least one of commands sent to well-site equipment, and data received from sensors in well-site equipment.

In one arrangement, the floating vessel further includes an intervention system onboard the floating vessel for conducting intervention services to an individual well, the intervention services comprising at least one of workover services and maintenance services, and the intervention system being configured to provide intervention services to an individual well of the first well-site while the floating vessel is located at the first well-site, and to an individual well of the second well-site after the floating vessel is relocated at the second well-site.

A ship is also provided for supporting offshore, hydrocarbon-bearing fields. The ship includes stationkeeping means for maintaining the position of the ship relative to a first subsea well-site. The ship also includes at least a portion of an operations control system connectible to the ship for providing well-site operations simultaneously to each of the first well-site and a second well-site. The operations control system may include at least communications for commands sent to well-site equipment, and data received from sensors in well-site equipment, and electrical power for providing power from the ship to subsea equipment located at the first subsea well-site and the second subsea well-site. The ship also includes a workover riser for conducting intervention services to an individual subsea well from the ship, the workover riser being selectively connectible to an individual well, and support structure for supporting a working string through the workover riser, the working string being deliverable into a wellbore of an individual well for performing at least one of workover services and maintenance services.

The ship in one embodiment further comprises a power delivery system for supplying the electrical power, the power delivery system being powered by at least one of the following: wind-generated power, solar-generated power, combustion of fuel gas provided from a subsea separator, and combustion of liquid hydrocarbon fuel provided from storage on board the ship.

A method is also provided for supporting multiple-well-site, offshore, hydrocarbon-bearing fields. The well-sites each have one or more wells. The method includes the steps of providing a control module at a first well-site; providing a control module at a second well-site; connecting the control module at the first well-site to the control module at the second well site with an inter well-site control network cable; moving a relocatable floating vessel to a position above the first subsea well-site; and connecting the surface vessel control link to the control module at the first well site. The floating vessel may have a surface vessel control link selectively connectible with the control module at the first well-site and the control module at a second well-site so that control operations may be conducted for both the first well-site and the second well-site from either well-site. The control operations may comprises at least communications for commands sent to well-site equipment, and data received from sensors in the well-site equipment.

The control communications may be selected from the group comprising: electrical signals, optical signals, wireless signals and combinations thereof. The control operations may further comprise operations selected from the group comprising: the delivery of chemicals to selected flowlines; the deliver of hydraulic fluid to selected subsea equipment; the delivery of low voltage electrical power for control equipment; and the delivery of electrical power for high power production equipment.

In the method, the floating vessel may further include an intervention system for conducting intervention services to an individual well, the intervention services comprising at least one of workover services and maintenance services.

Description of Embodiments Shown in the Drawings

The following provides a description of specific embodiments shown in the drawings for supporting multiple-well-site, offshore, hydrocarbon-bearing fields. Also described are specific relocatable floating vessels for supporting offshore, hydrocarbon-bearing fields. Explicit references to the drawings are included.

The system first includes a floating vessel. The floating vessel is relocatable from a first offshore well-site to a second offshore well-site. The floating vessel may be ship-shaped, or may be a floating barge or platform. Stationkeeping functions are provided for maintaining a desired location of the vessel.

The system may also include an operations control system. The specific control operations will include communications for sending and receiving control commands to equipment, and for retrieving data from sensors in the production system for monitoring purposes. "Control operations" may optionally also include providing electrical power, including low voltage for control equipment such as gauges, valves, sensors and other low power-consuming equipment, and high power for operating electrical submersible pumps, multi-phase pumps, compressors, separators and other high power-consuming equipment. Control operations may also include providing hydraulic fluid to production or processing equipment, such as shut-in valves. Control operations may further include the injection of chemicals such as paraffin or wax inhibitors into flow lines. "Control link" will always include a form of communication to/from the well-sites, and will likely include "control power" for the well-sites, although local "control power" may be employed.

In one embodiment, the operations control system is configured to support production operations to individual wells and other items of subsea equipment for both a first well-site and a second well-site (or more) while the floating vessel is positioned at the first well site. As used herein "support" or "supporting" well sites, wells, hydrocarbon-bearing fields or production operations includes using any of the intervention systems or operations control systems described herein. In one embodiment, the operations system operates by a network of cables. First, a surface vessel control link cable is provided that extends from the relocatable vessel, to a control module of a given well-site. Where the well-site is a subsea well-site (as opposed to a well-site configuration that employs a production platform), the control module is on the ocean bottom. The surface vessel control link is a control line for providing operations control as described above. This means that the surface vessel at least includes a communications link that sends signals to and receives signals and data from sensors, tool actuators, or other equipment. An example of a sensor is a downhole temperature sensor. Such a surface vessel control link may operate through electrical signals, optical signals, or a combination thereof. Additional control functions may also be included such as hydraulic power, electrical power, or chemical distribution, as described above.

The vessel control link is disconnectible from the control module of one well-site, and reconnectible to the control module of a second well-site when the floating vessel is relocated. The terms "detachable" and "selectively connectible" may be used interchangeably with the term "reconnectible." In each instance, the surface vessel control link is intended to be connectible to a control module at a selected well-site. The surface vessel control link may connect to a control module on a production platform at the ocean surface. The floating vessel may then be configured to selectively connect to the surface control module upon docking with a selected production platform. Alternatively, the floating vessel may connect to a control module subsea. A multiple quick-connect type connector may be employed for the connection between the vessel control link and the control module.

The operations control system may include an inter well-site control network connecting the one or more well-sites. More specifically, the inter well-site control network connects control modules associated with the individual well-sites. This network enables control commands to be sent from the surface vessel, through the surface vessel control link, and to a control module associated with a first offshore well-site, and then through the inter well-site control network to each control module associated with other offshore well-sites. From there, the control command is directed to a valve, pump, line or sensor (depending upon the desired control function) associated with the collection manifold or with an individual well or flowline. The inter well-site control network thus provides a communication link between well-sites, and may also include hydraulics, electrical power and/or chemical distribution.

The well-site support system may also include an intervention system. The intervention system is preferably placed onboard the floating vessel for conducting intervention services to an individual well. The intervention services comprise at least one of workover services and maintenance services. In this disclosure, "workover" refers to both major and minor well interventions. Major interventions are those that require the pulling of tubing from the well. Examples include the replacement of tubing joints and the replacement of an electrical submersible pump. Minor interventions, on the other hand, do not require the pulling of tubing. Examples include the running of logging equipment, changing of pressure or temperature gauges through the running of wireline or coiled tubing, the injection of acid or other treating fluids, and the like. "Maintenance" refers to the maintaining of equipment at the mudline or the wellhead platform, including equipment associated with the wellhead, the collection manifold, and any subsea fluid separators. An example is the changing out of a gate valve.

The well intervention system is configured to provide at least one of workover and maintenance functions to individual wells. When performing workover procedures for wells having a subsea christmas tree, the well intervention system preferably utilizes a workover riser. The workover riser extends from the relocatable vessel, downward to the wellhead of an individual well. The workover riser is preferably connected to the wellhead before intervention operations are conducted. Thereafter, the workover riser is disconnected from the wellhead of one well and reconnected to the wellhead of another well in that subsea well-site. Alternatively, the vessel may be relocated to a second subsea well-site, where the workover riser may be connected to a production or injection well in that second well-site. The intervention system may optionally utilize a derrick, a coiled tubing reel and injector, or a wireline and lubricator, depending upon the nature of the intervention.

When performing either workover or maintenance procedures for wells having a subsea wellhead, the well intervention system preferably utilizes an ROV system. The ROV system includes a mechanical umbilical for lowering a working class ROV into the ocean, and then pulling it back to the vessel. It may also include associated equipment, such as control cables extending from the vessel, and a storage facility on the vessel. A command station may also be placed on the vessel for controlling the ROV during workover or maintenance procedures.

The well intervention system may also be utilized for wells having a wellhead at a production platform. In this instance, production tubing extends upward from the ocean bottom to the production platform. Thus, an ROV system is not needed for an intervention procedure. Likewise, a subsea workover riser is not required. In either instance, a well intervention apparatus is provided on the floating vessel, the well intervention apparatus being selected from the group consisting of at least one of a derrick, a coiled tubing spool, a wireline and an ROV lowered to the sea floor via an umbilical.

FIG. 1 presents a schematic view of at least one version of a system 100 for supporting multiple well-site fields. Various fields are shown at 10, 20 and 30. The fields 10, 20, 30 of FIG. 1 are located offshore. To depict the offshore context, a surface waterline is shown at 102, while a mudline is generally shown at 104.

In the illustrative view of FIG. 1, the three fields 10, 20, 30 are shown separately, that is, having no fluid and pressure communication between the reservoirs. However, the present inventions are not limited in scope in this manner. To this end, the fields 10, 20, 30 may share one or more common subterranean reservoirs.

In the system 100 of FIG. 1, the three fields 10, 20, 30 are being produced through three separate subsea well-sites. The well-sites are shown at 110, 120 and 130. Each well-site 110, 120, 130 has a plurality of wells 112, 122, 132 clustered together. For example, and by way of example only, the first and second well-sites may be separated by a distance of up to one mile (1.6 kilometers). Distances between the different well-sites may vary depending on reservoir location or structure. Typical distances range from, but are not limited to, 0.5 to 20 miles (0.8 to 32 kilometers). In the various embodiments of the invention, the well-sites may be greater than 0.5 miles (0.8 kilometers) apart, alternatively greater than 1 or 2 miles (1.6 to 3.2 kilometers) apart, or alternatively from 1 to 20 miles (1.6 to 32 kilometers) apart. Each well 112, 122, 132, in turn, has a wellhead fixed at the subsea mudline 104. The wellheads of system 100 have subsea christmas trees 114, 124, 134 affixed thereon.

The various wells 112, 122, 132 and trees 114, 124, 134 of FIG. 1 are shown schematically. It is understood that each well 112, 122, 132 includes a wellbore that includes a surface casing extending from the mudline 104 downward into earth formations. It is further understood that each well 112, 122, 132 has at least one liner string cemented into the borehole to isolate formations behind the liner strings. These liner strings may provide a single borehole, or may provide lateral boreholes off of a parent borehole. It is also understood that one or more strings of production tubing are provided in the wellbore of each well 112, 122, 132 to provide a flowpath for production fluids to the wellhead. It is also understood that the trees 114, 124, 134 of each well have valves for controlling or shutting off fluid flow from the wellbores. These various components of the wells 112, 122, 132 are not shown. Finally, it is understood that one or more of the wells servicing each field may be an injection well rather than a producing well, and will have a christmas tree on the wellhead As noted, each well-site 110, 120, 130 has a plurality of wells 112, 122, 132 clustered together. Each well 112, 122, 132 has a flow line jumper 116, 126, 136 extending from the trees 114, 124, 134 in order to transport production or injection fluids. The flow line jumpers 116, 126, 136 in each respective well site 110, 120, 130 tie into a collection manifold 115, 125, 135. In this way, production fluids from a well-site can be commingled for unitary transportation to another location (such as a gathering facility seen at 190 in FIG. 5).

In FIG. 1, various flow lines are shown. The first flow line is seen at 142, and extends from manifold 115 at the first subsea site 110. The second flow line is shown at 144, and extends from manifold 125 at the second subsea site 120. Finally, the third flow line is seen at 146, and extends from manifold 135 at the third subsea site 130. The first flow line 142 ties into the second manifold 125. In this manner, the first 115 and second 125 collection manifolds actually share a single export flow line 144. The third manifold 135 has its own dedicated export flow line 146. Each production export line 144, 146 carries produced fluids to a gathering and processing facility. Of course, it is understood that the scopes of the present inventions are not limited to the arrangement of production export lines.

The system 100 includes a floating vessel 150. The floating vessel 150 is seen located at the water surface 102 generally above the first well-site 110. It is understood that the term "above" is not limited to a direct vertical relationship with any particular well or downhole equipment. The floating vessel 150 is configured to be relocatable to a location generally above any of the other subsea well sites, e.g., site 120. The floating vessel 150 may be a semisubmersible platform or other towed vessel. However, it is preferred that the floating vessel 150 be self-propelled, and ship-shaped.

The vessel 150 comprises two sets of systems. The first system is an operations control system 180. The specific control operations will include communications. "Communication" refers to the transfer of data for monitoring purposes, or for sending and receiving commands, or both. "Control operations" may optionally also include providing electrical power, including low voltage for control equipment such as gauges and valves, and high power for operating subsea equipment as described above. Hydraulics and electrical low power are both considered "control power". "Control power" refers to sending hydraulic or electrical low power for the operations of gauges, valves, sensors, and other low power-consuming equipment. "High power" refers to providing hydraulic or electric high power for electrical submersible pumps, multi-phase pumps, compressors, and other high power-consuming equipment. The "Controls link" will preferably include a form of communication to and from the well-sites, and will preferably include "control power" for the well-sites, although local "control power" may be employed. Control operations may further include the injection of chemicals such as hydrate, paraffin, or wax inhibitors into flow lines. Subsea equipment that is subject to control operations includes, but is not limited to, valves and chokes (not shown) associated with wellheads, e.g., 114, 124 and 134, and respective flow-lines, e.g., lines 142, 144 and 146 and christmas trees. It may also include pumps and other electrically or hydraulically actuated equipment. It may also include gauges.

The operations control system 180 preferably employs two control links. The first link is a surface vessel control link 182 that extends from the relocatable vessel 150, downward to one of the collection manifolds, e.g., manifold 115. The second link forms an inter well-site controls network 184 that connects the subsea well-sites 110, 120, 130 together. In one arrangement, the inter well-site controls network 184 interconnects with control modules incorporated into respective collection manifolds 115, 125, 135. In an alternative embodiment (not shown) the well-site controls network can be configured such that there is a one or more main lines containing branches which connect to each control module. In such an arrangement control modules incorporated into collection manifolds are not incorporated into the well-site controls network chain but are located at the end of branches taken off of such chain. The term "control module" is intended to include any electrical or fluid manifolding apparatus for directing communication, power, signals and/or fluids to subsea equipment. In this way, control may be transmitted to valves, trees 114, 124, 134 and other equipment, either subsea or on a production platform.

Figure 4:
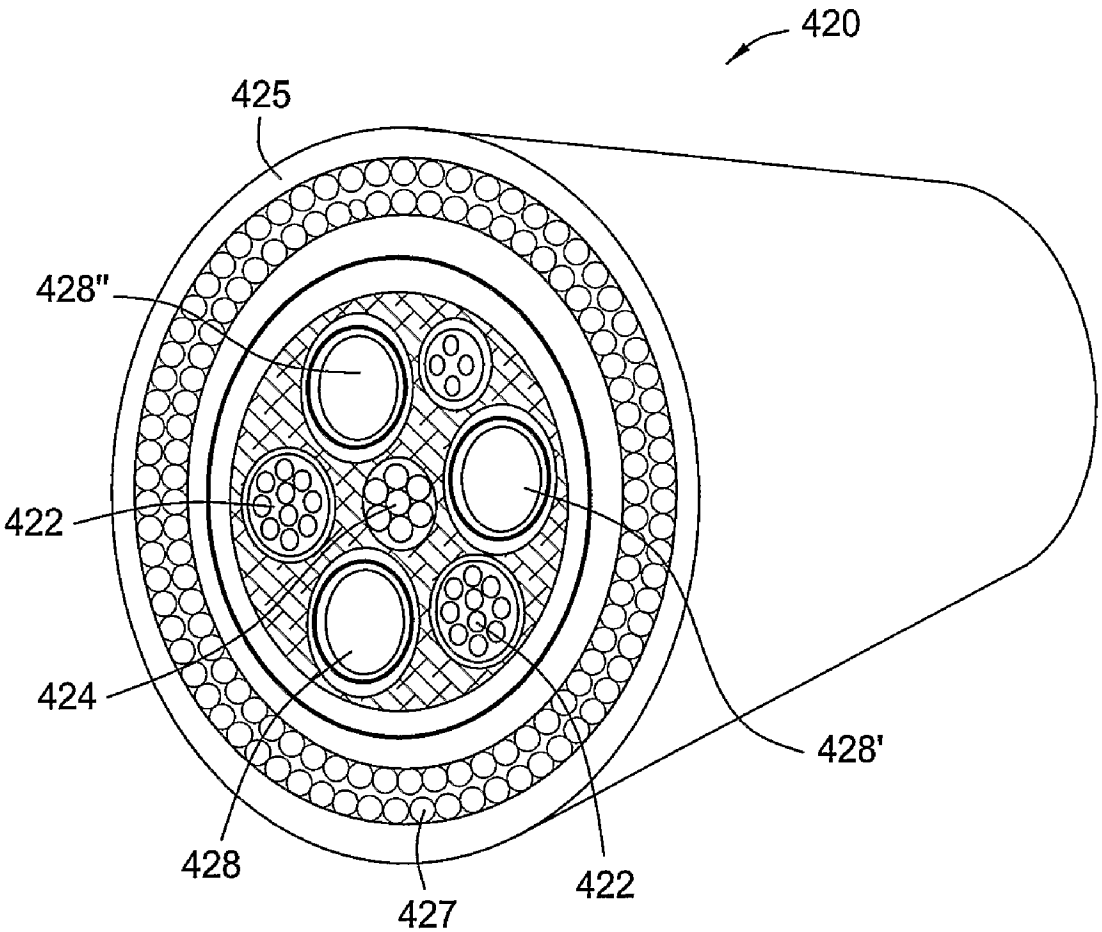
FIG. 4 provides a perspective, cut-away view of an illustrative integrated line as may be used to transmit control features for the system. A fluid delivery conduit is also optionally provided.

The surface vessel control link 180 and the subsea controls network 184 communication links may include, control power or chemicals, and may or may not be integrated into the same umbilical or cable as the communication links 180, 184. An exemplary integrated line is shown in FIG. 4. FIG. 4 provides a perspective, cut-away view of an exemplary integrated line 420 as may be used to transmit power and other control features for the system 100. Electrical power cables are seen at 422, while data and communication lines are seen at 424. Line 424 represents a digital cable line and may be a fiber optic line. Also seen in the exemplary line 420 are fluid distribution lines 428, 428'. Lines 428 and 428' are preserved for the delivery of chemicals, such as hydrate inhibition fluids. Chemicals may be delivered from the lines 428, 428'and then through the manifold 115 for treatment of flow lines, valves, and even the wellbores as appropriate. Line 428" is provided for delivery of hydraulics. Finally, the cable 420 includes a jacket 425 and a pair of armor layers 427.

It is to be understood that cable 420 of FIG. 4 is illustrative. The present inventions are not limited to any particular cable configuration. In this respect, separate power, communications, chemical and hydraulics cables may be employed as a "control line." Two separate lines are shown at 180 in FIG. 1. Still further, when referring to a control line, the term "communication line" may be any type of communication link, including both hard wired and wireless transmissions. Examples of wireless transmissions include RF communications and acoustic communications.

Referring back to FIG. 1, the surface vessel control links 180 are connected at one end to the floating vessel 150. At the other end, the surface vessel control links 180 are connected to the collection manifold 115. Preferably, a control module is associated with each collection manifold 115 to releasably receive the surface vessel control link 180. The surface vessel control link 180 may be disconnected from the subsea control module of one subsea well site, e.g., site 110, and reconnected to the control module of a second well site, e.g., site 120. In this way, the vessel control link 180 is detachable from or connectible to a control module at a selected well-site, and reconnectible to the control module at a second well-site when the floating vessel is relocated.

The second system that may be placed onboard the floating vessel 150 is a well intervention system 170. The well intervention system 170 is capable of providing workover functions to individual wells 112, 122, 132 downhole, and/or maintenance functions to subsea equipment In this disclosure, "workover" refers to major interventions that require the pulling of tubing from the well. Examples include the replacement of tubing and the replacement of an electrical submersible pump. "Workover" also refers to minor interventions that do not require the pulling of tubing. Examples include the running of logging equipment, changing of pressure or temperature gauges through the running of wireline or coiled tubing, the injection of acid or other treating fluids, the refilling of subsea pig launchers, and the like. "Maintenance" refers to the maintaining of equipment at the mudline, including equipment associated with the wellhead, the collection manifold, and any subsea fluid separators. An example would be the replacement of the gate valve (not shown) on a christmas tree.

In one arrangement, the well intervention system 170 operates through the use of a workover riser 172 and an ROV system 508. The workover riser 172 is employed in connection with workover services. The ROV system 508 is utilized during both workover and maintenance services.

The ROV system 508 generally comprises a mechanical umbilical 506 for lowering and raising a working class ROV into and from the water. The system 508 also includes the ROV 508' itself. The ROV 508' aids in servicing subsea equipment as would be known by those of ordinary skill in the art of offshore well servicing. The system 508 also includes other features not shown, such as control equipment on the vessel 150, a power cable providing power to the ROV 508', and a storage facility on the vessel 150.

The workover riser 172 may be any known workover riser that provides a pressure connection from the seafloor to the sea surface. It can be made from standard production tubing, drill pipe, or dedicated completion/workover riser joints. The riser 172 extends from the relocatable vessel 150, downward through the ocean to the wellhead of an individual well. The riser 172 is connected to a well before intervention operations are conducted. In the view of FIG. 1, the riser 172 is affixed to a well 112 at the first subsea well-site 110. However, the riser 172 may be disconnected from the wellhead of well 112, and reconnected to the wellhead of any other well in that subsea well-site 110. Alternatively, the vessel 150 may be relocated to a second subsea well-site, e.g., site 120, where the workover riser 172 may be connected to a production or injection well in that second well-site, e.g., well 122.

As demonstrated above, the system 100 can be used for supporting multiple well-sites offshore. The system 100 includes the relocatable vessel 150 as described above. The system 100 further provides an inter well-site control network 184 connecting the one or more well-sites 110, 120. In one arrangement, the inter well-site control network 184 connects control modules positioned on respective collection manifolds 115, 125 associated with the individual well-site clusters 110, 120. The inter well-site control network lines 184 enable communication commands to be sent from a surface vessel control link 180, downward to a control module associated with a first subsea well-site 110, and then through the inter well-site control network 184 to a control module associated with a second subsea well-site 120. From there, communication commands are directed to a valve or pump associated with the collection manifold, e.g., 115 or 125, or with an individual well, e.g., 112, 122. In this manner, a system 100 is provided whereby control of equipment at one well-site may be provided even while the floating vessel 150 is located for intervention or other reasons at another well-site.

Referring specifically to the vessel 150 of FIG. 1, in the arrangement of FIG. 1 the vessel 150 is a ship. The ship is capable of self-propulsion by known means, such as an electro-hydraulically powered engine, rudder, and steering system. In this manner, the ship 150 may propel itself from the first subsea well-site 110 to the second 120 or third 130 subsea well-sites. It is understood that the floating vessel 150 need not be self-propelled. In this respect, the vessel 150 may be towed from well-site to well-site by a separate working boat (not shown). However, the vessel 150 will have a hull 152 for providing floatation and stability to the vessel 150. The hull 152 may be a ship-shaped monohull, a hull for a semisubmersible floating vessel, or other arrangement.

The ship 150 optionally includes a power delivery system. A power delivery system is shown schematically at 156. The power delivery system 156 delivers power from the ship 150 to subsea equipment located at the subsea well-sites 110, 120, 130. The power delivery system 156 includes a known power system, such as a fuel generator. In a typical embodiment, power would be generated by the combustion of fuel gas supplied via a fuel gas return line, such as line 162 shown in the embodiment of FIG. 5. Gas is supplied via a subsea separator, seen at 160 in FIG. 5. Liquid hydrocarbon fuel would be used during disconnections or when fuel gas is not available. An alternative embodiment uses wind or solar power. The power delivery system 156 also comprises a communication link, such as one of cables 180, or a wireless link.

The ship 150 optionally also includes a control delivery system. The control delivery system is located onboard the ship 150, and is able to control subsea equipment located at the subsea well-sites 110, 120, 130. The control delivery system is shown schematically in FIG. 1 at 158. The control delivery system 158 may be any control system. It also comprises a communication link, such as one of cables 182, or a wireless link.

As noted above, the ship 150 may also include an intervention system 170 located onboard the ship 150. The intervention system 170 includes any known support structure 174 for supporting a working string (not shown). The working string is deliverable into a wellbore of an individual well, e.g., well 112, for performing at least one of workover services and maintenance services. The working string typically will have a tool string (also not shown) for conducting operations within the wellbore. The working string and tool string are lowered into the wellbore through the workover riser 172.

Figure 2:
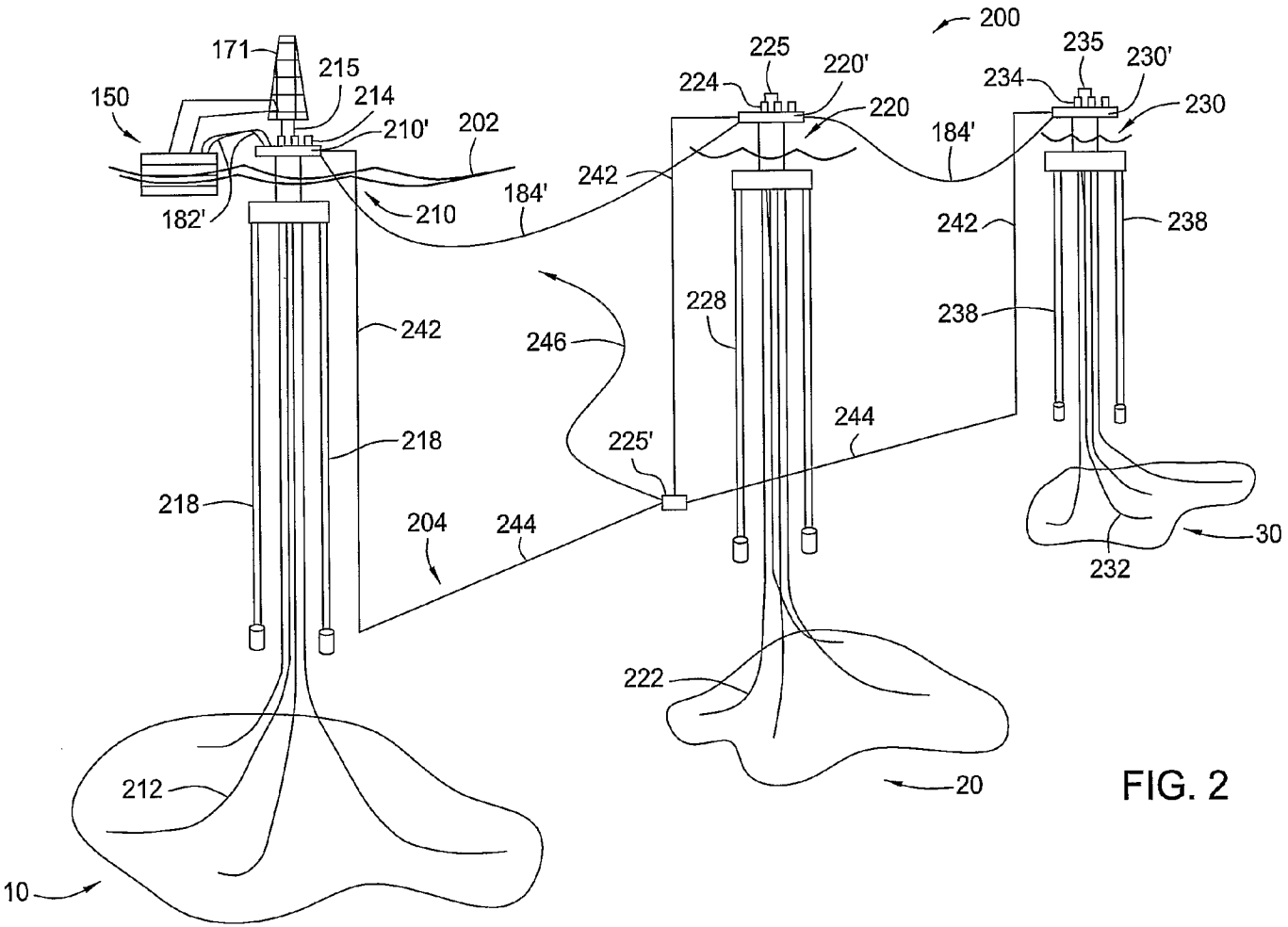
FIG. 2 also shows a system for supporting multiple-well-site, offshore fields, but in an alternate arrangement. In this view, a production platform is provided at each well-site so that the wellheads for the individual wells are at the surface of the water. A floating vessel is again seen located at the first well-site.

FIG. 2 presents a system 200 for supporting multiple-well-site offshore hydrocarbon-bearing oil fields, in an alternate arrangement. As with FIG. 1, various offshore fields are shown at 10, 20 and 30. A surface waterline is shown at 202, while a mudline is generally shown at 204. The three fields 10, 20, 30 are again being produced through three separate well-sites. The well-sites are shown at 210, 220 and 230 at the waterline 202. Each well-site 210, 220, 230 has a plurality of wells 212, 222, 232 clustered together. A wellbore extends downward into the earth from the mudline 204.

In the arrangement described above for FIG. 1, each well 112, 122, 132 has an attached christmas tree 114, 124, 134 at the subsea mudline 104. Each well 112, 122, 132 also has an associated flow line jumper 116, 126, 136 extending from the respective christmas trees 114, 124, 134. The flow line jumpers 116, 126, 136 tie into respective subsea collection manifolds 115, 125, 135. However, in the arrangement of FIG. 2, the christmas trees 214, 224, 234 for the wells 212, 222, 232 are positioned on respective production platforms 210', 220', 230'. This means that the wellbores for each well 212, 222, 232 essentially extend upward from the sea floor 204 to the production platforms 210', 220', 230', through risers. In such an arrangement, the christmas trees 214, 224, 234, at the surface 202 are "dry" trees. Individual well flow line jumpers (not seen) extend from the platform trees 214, 224, 234 to collection manifolds 215, 225, 235 on the production platforms 210', 220', 230'.

It is observed from FIG. 2 that the system 200 does employ a subsea production export line 246. Production fluids collected at the collection manifolds 215, 225, 235 on the platforms 210', 220', 230' are re-delivered to the ocean bottom 204, via dedicated return fluid lines 242, 244. These production lines 244 are commingled through a subsea manifold 225'. An export line 246 then delivers the fluids to a gathering facility (not shown in FIG. 2). It is again to be understood that the system 200 is exemplary, and that the scope of the inventions in this disclosure are not limited by any specific network of production lines.

In the system 200 of FIG. 2, the production platforms 210', 220', 230' are moored to the ocean bottom 204 in any conventional manner. Mooring lines 218, 228, 238 are shown affixing the production platforms in position. However, the scope of the inventions in this disclosure are not limited by any specific mooring arrangement. For example, the platforms 210', 220', 230' may employ dynamic positioning.

The system 200 of FIG. 2 also utilizes a floating vessel 150 as described above. When production platforms, e.g., platform 210', are used, the floating vessel 150 is located at the well-site 210 adjacent the platform 210'. A floating vessel 150 is seen in FIG. 2 adjacent platform 210'. Stationkeeping is employed with the vessel 150. Stationkeeping may be provided through an anchoring system, dynamic positioning, or both.

One or more surface vessel control links 182' is seen in connection with multi well-site support system 200. In the arrangement of FIG. 2, the vessel control links 182' link the floating vessel 150 with the production platform, e.g., platform 210', at which the vessel 150 is "docked." In this way, communication signals and data may be transmitted through the control links 182' between the vessel 150 and production equipment on the platform 210'. For example, when the floating vessel 150 is "docked" adjacent a platform, e.g., platform 210', an electrical connection is made between the vessel 150 and a control module on the platform 210' in order to provide power/or other control operations to the well-site 210, The vessel control link extends from the floating vessel 150 and releasably connects to the production platform 210' to provide selective control to the well-site 210.

Inter well-site control networks 184' are also employed to interconnect the well-sites 210, 220, 230. In the arrangement of FIG. 2, cables 184' can be seen in a "daisy chain" configuration, connecting production platforms 210', 220', 230', The inter well-site control network 184' enables the vessel 150 to control operations for production equipment and wells at various well-sites, regardless of where the vessel 150 is docked. In alternative embodiments of the invention the inter well-site control network cables 184' can be arranged such that they run at least partially along the sea floor.

Concerning the intervention system, the vessel 150 would again include an intervention system as described above. A workover riser is not needed in the system 200 of FIG. 2, since the various 212, 222, 232 wellbores may be accessed directly from the respective production platforms, 210', 220', 230' through a derrick 171 (or optionally a coiled tubing spool). However, an ROV support system would still be provided for maintenance and is employed in connection with intervention services and transported by the vessel 150. The intervention system may be affixed to the vessel 150 and cantilevered over the platform 210' during intervention services, or the intervention system may be moved from the vessel 150 onto the platform 210' as needed for conducting intervention services. In the arrangement of FIG. 2, the derrick 171 is cantilevered over the centerline of a wellbore 212 for intervention.

Figure 3:
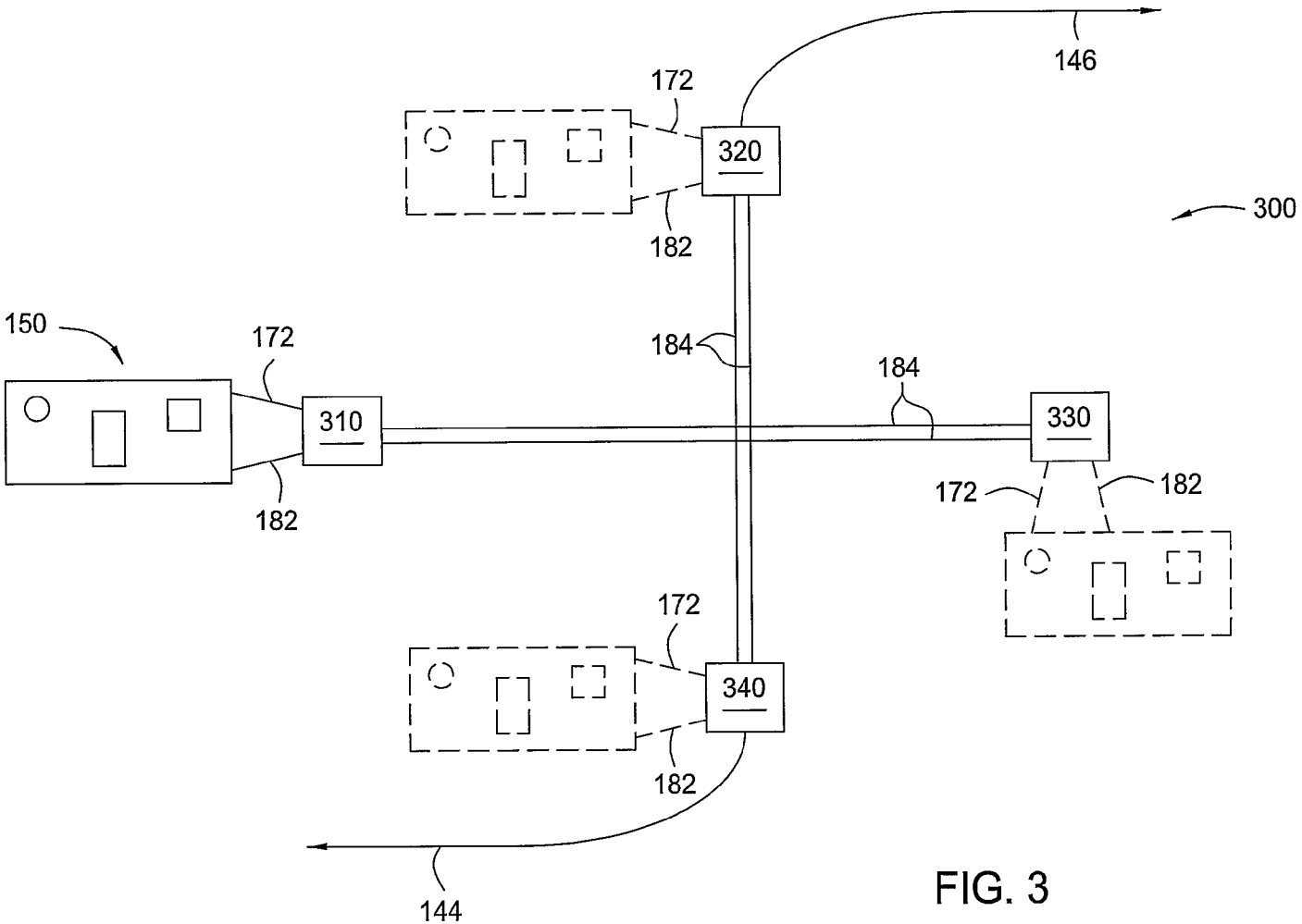
FIG. 3 presents a top view of a plurality of offshore well-sites. Four illustrative sites are shown, with a floating vessel of the present invention located along one of the well-sites. Surface and subsea control lines for the production system are also shown, demonstrating that the well-sites are interconnected for purposes of transmitting communication and possibly power operations to subsea equipment. The communication link may be hard-wired or wireless.

FIG. 3 presents a top view of a plurality of offshore well-sites, with a system 300 for producing hydrocarbons from the well-sites. Four exemplary sites 310, 320, 330, 340 are shown, with a floating vessel 150 of the present invention located adjacent a first of the well-sites 310. Individual wells are not shown, though it is understood that wells are clustered within the schematically shown well-sites 310, 320, 330, 340. Surface 182 and subsea 184 communication lines for the production system 300 are also shown, demonstrating that the well-sites 310, 320, 330, 340 are interconnected for purposes of providing power and/or control to subsea equipment. The potential position of the vessel 150 is shown in broken lines adjacent well-sites 320, 330, 340. The potential position of a workover riser 172 and surface control lines 182 extending from the vessel 150 are also seen adjacent each well site. The broken lines serve to demonstrates that the vessel 150 may be positioned adjacent any of the well-sites for simultaneous intervention services in one well, and control services for all wells. Lines 144 and 146 again represent production export lines.

Figure 5:
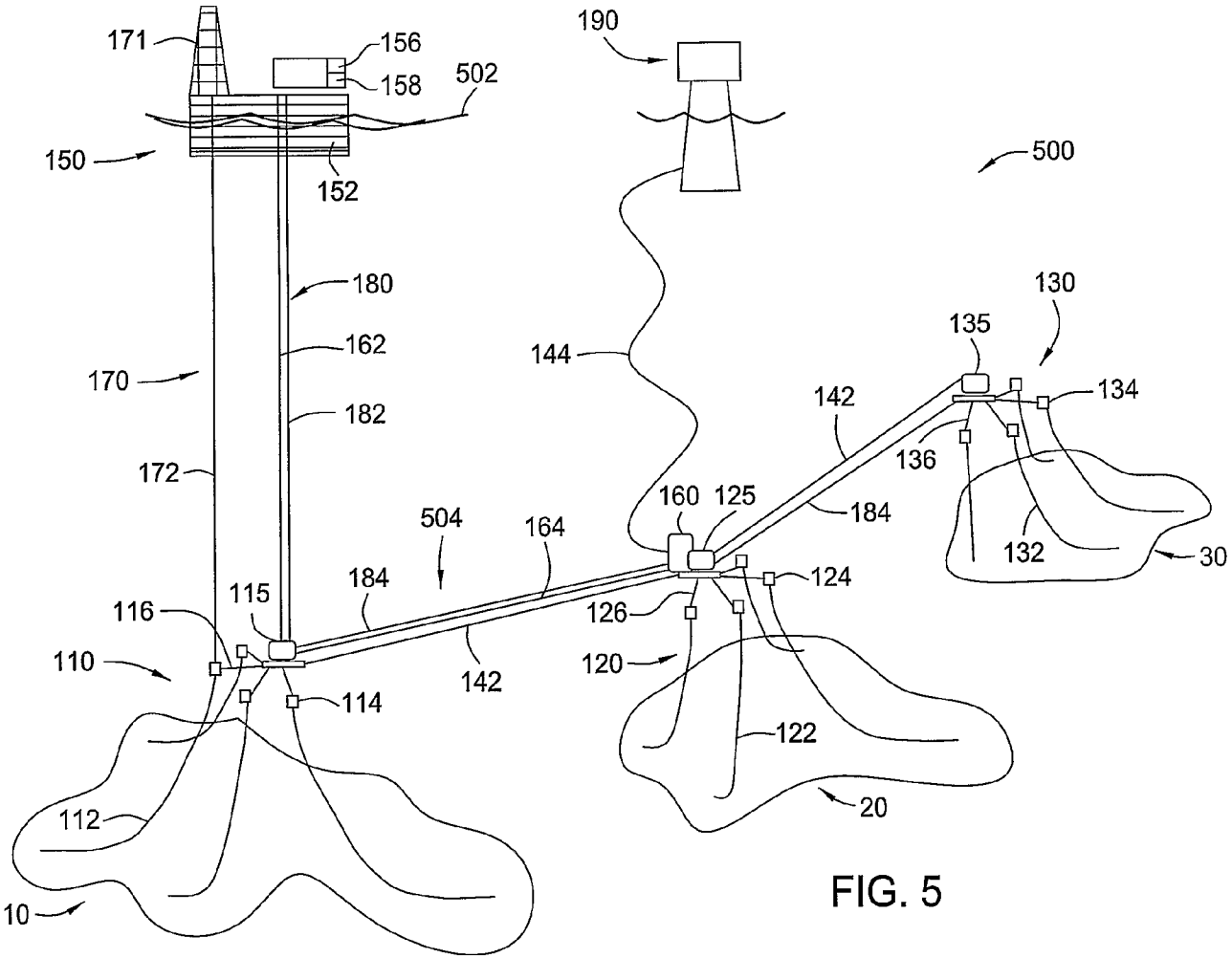
FIG. 5 presents a system for supporting multiple-well-site offshore hydrocarbon-bearing oil fields generally in accordance with the system of FIG. 1. Three separate subsea well-sites are again presented, with each site having a plurality of wells clustered together. Each well has a wellhead fixed at the subsea mudline. A floating vessel is again seen located above a first well-site. In this arrangement, optional subsea equipment is shown, including a subsea separator and return gas fuel lines.

Finally, FIG. 5 presents a system 500 for supporting multiple-well-site offshore hydrocarbon-bearing oil fields generally in accordance with the system of FIG. 1. A waterline is shown at 502, and a mudline at 504. Three separate subsea well-sites 110, 120, 130 are again presented, with each site having a plurality of wells 112, 122, 132 clustered together. Each well 112, 122, 132 has a wellhead and trees 114, 124, 134 fixed at the subsea mudline. A floating vessel 150 is again seen located above a first well-site 110. In this arrangement, optional subsea equipment is shown. The equipment includes a subsea separator 160 and return gas fuel lines 162, 164.

The subsea separator 160 is in fluid communication with the second collection manifold 125 and a production export line 144. Production fluids that exit the collection manifold 125 travel to the subsea separator 160 en route to a remote collection and processing facility 190. The separator 160 represents either a two-phase or three-phase separator. In either instance, the separator 160 is able to separate out produced gas from produced liquids. The produced fluids are directed on to the production export line 144, while some or all of the separated gas is sent back to the floating vessel 150. Optionally some of the gas will be combined with liquids for delivery to gathering facility 190. In an alternative embodiment, the third collection manifold 135 can be connected to the subsea separator 160 through a separate fuel gas line (not shown) running between third collection manifold 135 and the subsea separator 160.

In FIG. 5, a subsea gas line 164 is seen. The subsea gas line 164 receives gas separated by the separator 160. In addition, a surface gas line 162 is seen. The surface gas line 162 delivers the separated gas to the surface of the ocean. In the arrangement shown in FIG. 5, the surface gas 162 is delivered to the floating vessel, where it is gathered and used as a fuel source for power generators. The generators, in turn, are used to provide power to subsea equipment such as electrical submersible pumps, fluid control valves, a multiphase fluid pump, and even the subsea separator 160 itself. In addition, the generators may provide power to selected operations on the floating vessel 150.

A description of certain embodiments of the inventions has been presented above. However, the scope of the inventions is defined by the claims that follow. Each of the appended claims defines a separate invention, which for infringement purposes is recognized as including equivalents to the various elements or limitations specified in the claims.

Various terms have also been defined, above. To the extent a claim term has not been defined, it should be given its broadest definition that persons in the pertinent art have given that term as reflected in printed publications, dictionaries and issued patents.

What is claimed is:

1. A system for supporting multiple-well-site, offshore, hydrocarbon-bearing fields, each well-site having one or more wells, the system comprising:

a floating vessel that is relocatable from a position at a first well-site to a position at a second well-site;

an operations control system selectively connectible to the floating vessel for providing well-site operations at the first and second well-sites, the operations control system comprising communications for at least one of commands sent to well-site equipment, and data received from sensors in well-site equipment, the operations control system comprising a control module at the first well-site;

a control module at the second well-site;

an inter well-site control network connecting the control module at the first well-site to the control module at the second well site;

a detachable surface vessel control link configured to selectively connect with the control module at the first well-site or the control module at a second well-site so that control operations may be conducted for both the first well-site and the second well-site from either well-site; and an intervention system onboard the floating vessel for conducting intervention services to an individual well, the intervention services comprising at least one of workover services and maintenance services, and the intervention system being configured to provide intervention services to an individual well of the first well-site while the floating vessel is located at the first well-site simultaneously with the control operations for both the first well-site and the second well-site, and to an individual well of the second well-site after the floating vessel is relocated at the second well-site simultaneously with the control operations for both the first well-site and the second well-site.

2. The system of claim 1, wherein the communications are accomplished through a medium selected from the group comprising: conductive wires for transmitting electrical signals, fiber optic cable for transmitting optical signals, an integral line containing both conductive wires for transmitting electrical signals and fiber optic cable for transmitting optical signals, air and water for transmitting wireless signals, and combinations thereof.

3. The system of claim 1, wherein the control operations further comprise operations selected from the group comprising: the delivery of chemicals to selected flowlines, trees and valves; the delivery of hydraulic fluid to selected equipment; the delivery of low voltage electrical power for control equipment, and the delivery of electrical power for high power production equipment.

4. The system of claim 1, wherein the inter well-site control network comprises at least one cable having a first end connected to the control module at the first well-site, and a second end connected to the control module at the second well-site.

5. The system of claim 1, wherein:

the wells of the first well-site have wet christmas trees;

the first control module is located on the ocean floor; and the inter well-site control network comprises at least one cable having a first end connected to the subsea control module at the first well-site, and a second end connected to the control module at the second well-site.

6. The system of claim 1, wherein:

the wells of the first well-site have dry christmas trees;

the first control module is located on a production platform with the dry christmas trees; and the inter well-site control network comprises at least one cable having a first end connected to the control module on the platform, and a second end connected to the control module at the second well-site.

7. The system of claim 1, wherein the control communications are selected from the group comprising: electrical signals, optical signals, wireless signals and combinations thereof.

8. The system of claim 1, further comprising:

a subsea separator capable of separating produced gas from produced liquids, the subsea separator receiving produced fluids from wells at a subsea well-site; and a return gas fuel line for delivering separated gas to the vessel.

9. The system of claim 1, wherein the operations control system further comprises power from the floating vessel to the first well-site and the second well-site to power one or more items of production equipment selected from the group consisting of an electrical submersible pump, a subsea separator, a multiphase fluid pump and fluid control valves.

10. The system of claim 1, wherein the surface vessel control link and the inter well-site control network each comprise a control cable that transmits digital signals generated from the floating vessel.

11. The system of claim 1, wherein each well of the first and second well-sites has a christmas tree at the ocean floor.

12. The system of claim 1, wherein each well of the first and second well-sites has a christmas tree on a production platform at the ocean surface.

13. A floating vessel for supporting multiple-well-site, offshore, hydrocarbon-bearing fields, each well-site having one or more wells, wherein:

the floating vessel is relocatable from a first well-site to a second well-site so that control operations may be conducted for both the first well-site and the second well-site from either well-site location, said floating vessel adapted to connect to a detachable surface vessel control link configured to selectively connect with a control module at the first well-site or a control module at a second well-site, an inter well-site control network connecting the control module at the first well-site to the control module at the second well site, thereby forming an operations control system connectible to the floating vessel for providing well-site operations simultaneously to each of the first and second well sites, the operations comprising communications for at least one of commands sent to well-site equipment, and data received from sensors in well-site equipment; and the floating vessel includes an intervention system onboard the floating vessel for conducting intervention services to an individual well, the intervention services comprising at least one of workover services and maintenance services, and the intervention system being configured to provide intervention services to an individual well of the first well-site while the floating vessel is located at the first well-site simultaneously with the control operations for both the first well-site and the second well-site, and to an individual well of the second well-site after the floating vessel is relocated at the second well-site simultaneously with the control operations for both the first well-site and the second well-site.

14. The floating vessel of claim 13, wherein the communications are accomplished through a medium selected from the group comprising: conductive wires for transmitting electrical signals, fiber optic cable for transmitting optical signals, and an integral line containing both conductive wires for transmitting electrical signals and fiber optic cable for transmitting optical signals.

15. The floating vessel of claim 13, wherein the control operations further comprise operations selected from the group comprising: the delivery of chemicals to selected flowlines, jumpers, trees and valves; the deliver of hydraulic fluid to selected subsea equipment; the delivery of low voltage electrical power for control equipment, the delivery of electrical power for high power production equipment.

16. The floating vessel of claim 13, wherein the inter well-site control network comprises at least one cable having a first end connected to the control module at the first well-site, and a second end connected to the control module at the second well-site.

17. The floating vessel of claim 13, wherein the operations control system further comprises power from the floating vessel to the first well-site and the second well-site to power one or more items of subsea equipment selected from the group consisting of an electrical submersible pump, a subsea separator, a multiphase fluid pump and fluid control valves.

18. The floating vessel of claim 13, wherein:

the intervention system further comprises a workover riser that is selectively connectible and disconnectible from a wellhead for an individual well in order to facilitate intervention operations.

19. A method for supporting multiple-well-site, offshore, hydrocarbon-bearing fields, each well-site having one or more wells, the method comprising:

providing a control module at a first well-site;

providing a control module at a second well-site;

connecting the control module at the first well-site to the control module at the second well site with an inter well-site control network cable;

moving a relocatable floating vessel to a position above the first well-site, the floating vessel having:

a surface vessel control link selectively connectible with the control module at the first well-site or the control module at a second well-site so that control operations may be conducted for both the first well-site and the second well-site from either well-site, such control operations comprising at least communications for commands sent to well-site equipment, and data received from sensors in the well-site equipment;

connecting the surface vessel control link to the control module at the first well-site;

relocating the relocatable floating vessel to a position above the second well-site; and reconnecting the surface vessel control link to the control module at the second well-site.

20. The method of claim 19, wherein the floating vessel further comprises an intervention system for conducting intervention services to an individual well, the intervention services comprising at least one of workover services and maintenance services.

21. The method of claim 19, wherein the communications are accomplished through a medium selected from the group comprising: conductive wires for transmitting electrical signals, fiber optic cable for transmitting optical signals, an integral line containing both conductive wires for transmitting electrical signals and fiber optic cable for transmitting optical signals, air and water for transmitting wireless signals, and combinations thereof.

22. The method of claim 19, wherein the control operations further comprise operations selected from the group comprising: the delivery of chemicals to selected flowlines;

the deliver of hydraulic fluid to selected subsea equipment; the delivery of low voltage electrical power for control equipment, the delivery of electrical power for high power production equipment.

* * * * *